US006485375B1

(12) United States Patent
McKinley

(10) Patent No.: US 6,485,375 B1
(45) Date of Patent: Nov. 26, 2002

(54) HIGH CG, MODULAR PUTTER

(75) Inventor: Robert C. McKinley, 1200 Neans Dr., Austin, TX (US) 78758

(73) Assignee: Robert C. McKinley, Austin, TX (US)

( * ) Notice: Subject to any disclaimer, the term of this patent is extended or adjusted under 35 U.S.C. 154(b) by 0 days.

(21) Appl. No.: 09/576,184

(22) Filed: May 23, 2000

Related U.S. Application Data

(60) Provisional application No. 60/136,066, filed on May 26, 1999.

(51) Int. Cl.[7] ..... A63B 69/36; A63B 53/04

(52) U.S. Cl. ..... 473/245; 473/252; 473/288; 473/340; 473/341; 473/342; 473/334

(58) Field of Search ..... 473/251, 252, 473/245, 288, 325, 340, 341, 335, 336, 337, 327, 349, 350, 342, 329, 332

(56) References Cited

U.S. PATENT DOCUMENTS 1,756,219 A * 4/1930 Spiker
3,516,674 A * 6/1970 Scarborough
D229,434 S * 11/1973 Irower
4,077,633 A * 3/1978 Studen
4,121,832 A * 10/1978 Ebbing
4,869,507 A * 9/1989 Sahm
5,193,810 A * 3/1993 Antonious
5,211,401 A * 5/1993 Hainey
5,282,622 A * 2/1994 Evans
5,344,149 A * 9/1994 Miller
5,437,447 A * 8/1995 Rigutto
5,544,879 A * 8/1996 Collins
5,803,825 A * 9/1998 Hamilton
5,839,974 A * 11/1998 McAllister
6,270,423 B1 * 8/2001 Webb

* cited by examiner

*Primary Examiner*—Sebastiano Passaniti

(57) ABSTRACT

A golf club putter featuring interchangeable one-piece large insert face blocks to allow the user to adjust the rebound characteristics by replacing the insert face blocks with a softer or harder compound. The face blocks may be provided with various lofts and with or without a groove pattern. An elliptical cavity on the rear of the face blocks provides a larger more consistent sweet spot. Interchangeable weight inserts provide for adjustment of the heel and toe weighting by varying the weight of the inserts placed in both the heel and toe weight chambers. The putter further includes protruding sight rails that run longitudinally from the rear to the front of the putter head, parallel to the centerline, which provide a high center of gravity weighting and assist the user in alignment and stroke direction.

1 Claim, 2 Drawing Sheets

HIGH CG, MODULAR PUTTER

Reference Provisional Patent Application No. 60/136, 066 Filed May 26, 1999

References Cited:
U.S. Pat. No. Documents

| Document U.S. Pat. No. | Date | Name | Classification |
|---|---|---|---|
| 6,019,686 | Mar., 2000 | Gray | 473/313; 473/330; 473/334; 473/341 |
| 6,001,030 | Dec., 1999 | Delaney | 473/329; 473/340; 473/342 |
| 5,921,871 | July, 1999 | Fisher | 473/329; 473/340; 473/342 |
| 5,839,974 | Nov., 1998 | McAlister | 473/337; 273/DIG 14; 473/340; 473/342 |
| 5,766,093 | June, 1998 | Rohrer | 473/329; 473/332; 473/340; 473/342 |
| 5,769,737 | June, 1998 | Holladay | 473/336; 473/340; D21/736 |
| 5,746,664 | May, 1998 | Reynolds | 473/252; 473/297; 473/307; 473/312 |
| 5,688,189 | Nov., 1997 | Bland | 473/314; 473/330; 473/336; 473/340 |
| 5,571,053 | Nov., 1996 | Lane | 473/336; 473/340; 473/341 |
| 5,533,725 | July, 1996 | Reynolds | 473/307; 473/338; 473/339; 473/341 |
| 5,441,274 | Aug., 1995 | Clay | 473/201; 473/246; 473/248; 473/251; 473/337; 473/339 |
| 5,437,447 | Aug., 1995 | Rigutto | 473/251; 473/288; 473/330; 473/341 |
| 5,429,356 | July, 1995 | Dingle, et al | 473/251; 473/313; 473/314; 473/334; 473/341 |
| 5,407,196 | April, 1995 | Busnardo | 473/246; 473/248; 473/251; 473/307; 473/329; 473/340 |
| 5,344,151 | Sept., 1994 | Anderson, et al | 473/337 |
| 5,332,214 | July, 1994 | Tucker, Sr. | 473/329; 473/337 |
| 5,275,413 | Jan., 1994 | Sprague | 473/337 |
| 5,253,869 | Oct., 1993 | Dingle, et al | 473/245; 473/334 |
| 5,246,227 | Sept., 1993 | Sun, et al | 473/337; 273/DIG 1 |
| 5,244,210 | Sept., 1993 | Au | 473/252; 473/336 |
| 5,230,509 | July, 1993 | Chavez | 473/336; 473/334 |
| 4,962,932 | Oct., 1990 | Anderson | 473/336 |
| 4,895,371 | Jan., 1990 | Bushner | 473/336 |
| 4,325,553 | April, 1982 | Taylor | 473/337; 473/332; 473/341 |
| 4,194,739 | Mar., 1980 | Thompson | 473/241; 473/248 |
| 4,121,832 | Oct., 1978 | Ebbing | 473/335; 473/288; 473/340 |

STATEMENT REGARDING FEDERALLY FUNDED RESEARCH OR DEVELOPMENT

Not Applicable

REFERENCE TO A "MICROFICHE APPENDIX"

Not Applicable

BACKGROUND OF INVENTION

During a round of golf, putting typically represents 40% or more of the strokes taken by the golfer, so it is crucial that the golfer be as accurate as possible with the putter. Although, there have been many innovations in the design of the golf putter with regard to rebound characteristics, alignment, and weight distribution, no design has brought all of the required elements together in such a configuration that allows for easy adjustment of each and every one of these characteristics to meet each golfer's needs. The High CG, Modular Putter design accomplishes this objective through the use of interchangeable rebound face block inserts and weight inserts, as well as, the incorporation of high center of gravity putter head weighting, sight rails, and an elliptical cavity back on the face block.

There have been other designs that incorporate adjustable weighting and interchangeable faces or inserts, but none of those designs have utilized the large face block insert, or the parallel symmetrical weight cavities that allow the majority of club head weight to be positioned on the heel and toe sections of the putter in such an adjustable configuration as utilized in this design. No previous design integrates a cavity backed face block insert. The high center of gravity component of design is not unique in itself, but is unique in that it coexists with the other design innovations such as the interchangeable cavity back face block inserts, adjustable weighting, and sight rails. No other design has brought all of these design components together in such a configuration as the High CG, Modular Putter.

SUMMARY OF THE INVENTION

The purpose of this design is to allow the user/golfer to configure or customize the putter according to his or her own specific needs and requirements. The benefit of such customization is to improve putting accuracy for that individual by modifying the golf putter's rebound characteristics, touch, feel, and swing weight. Such customization also allows the user to adjust the heel/toe weight bias, balance, center of gravity, stroke and swing plane/direction, as well as distance traveled by the golf ball on impact and the golf ball velocity after impact. The High CG putter head weighting will provide a higher center of gravity, which in turn will cause the golf ball to begin rolling more quickly after impact because it will leave the club face on a lower trajectory. The sight rails assist the user/golfer with regard to better alignment towards the target, and a truer stroke plane. The user/golfer can adjust or reconfigure the putter by removing the one-piece, face block and replacing it with another face block having different characteristics that relate to face hardness and rebound characteristics, groove patterns, shape, or loft. The user/golfer can also adjust the heel/toe weight bias and/or overall putter head weight by removing the face block and replacing the weight inserts with either lighter or heavier inserts in each weight chamber.

DESCRIPTION OF THE VIEWS AND COMPONENTS OF THE DRAWINGS

COMPONENT DESCRIPTIONS

Figure 1:
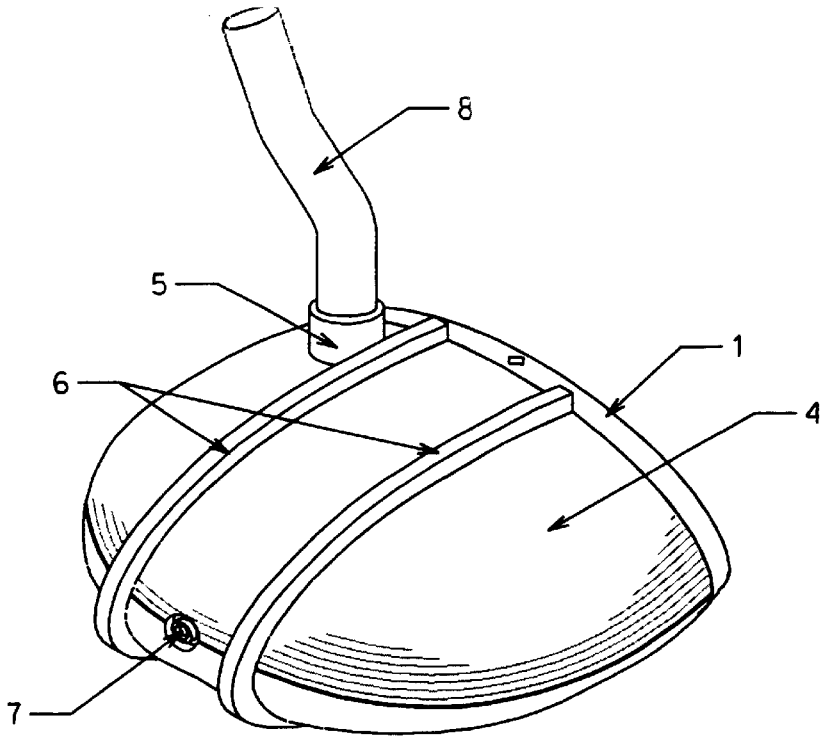
FIG. 1 shows a rear prospective of the assembled putter and it's components
Figure 2:
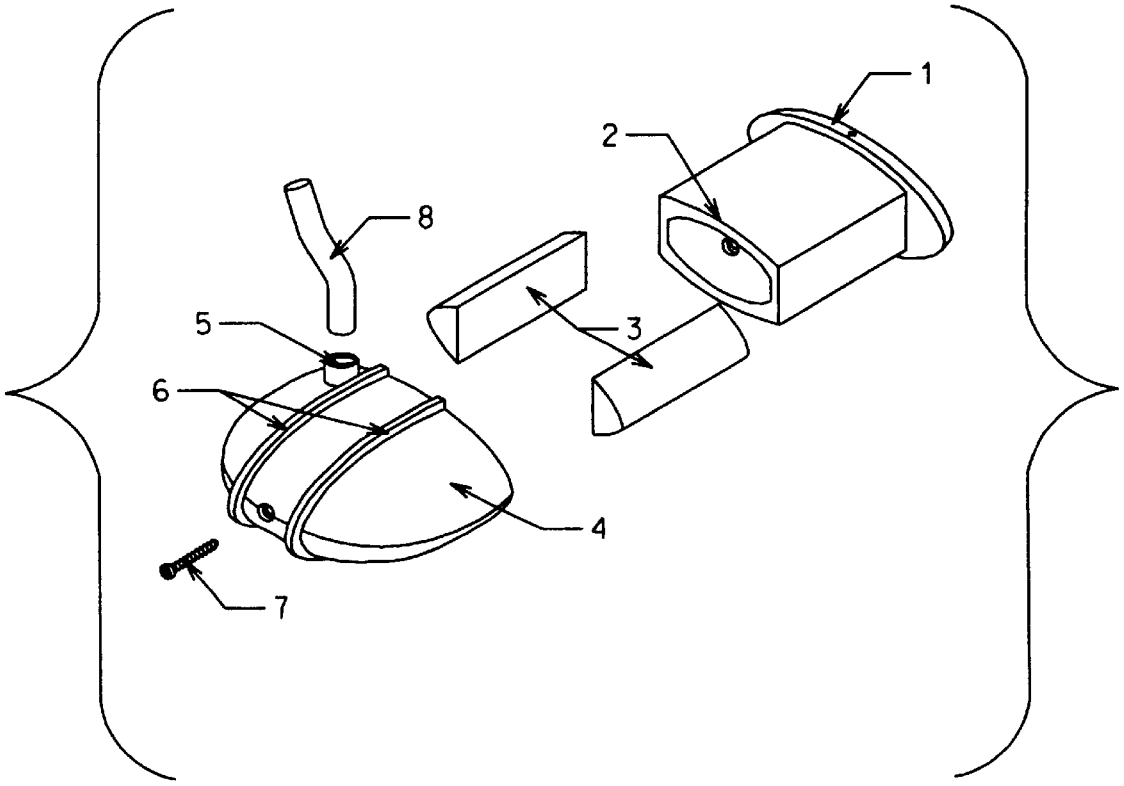
FIG. 2 shows an exploded view of the rear perspective and the individual putter components
Figure 3:
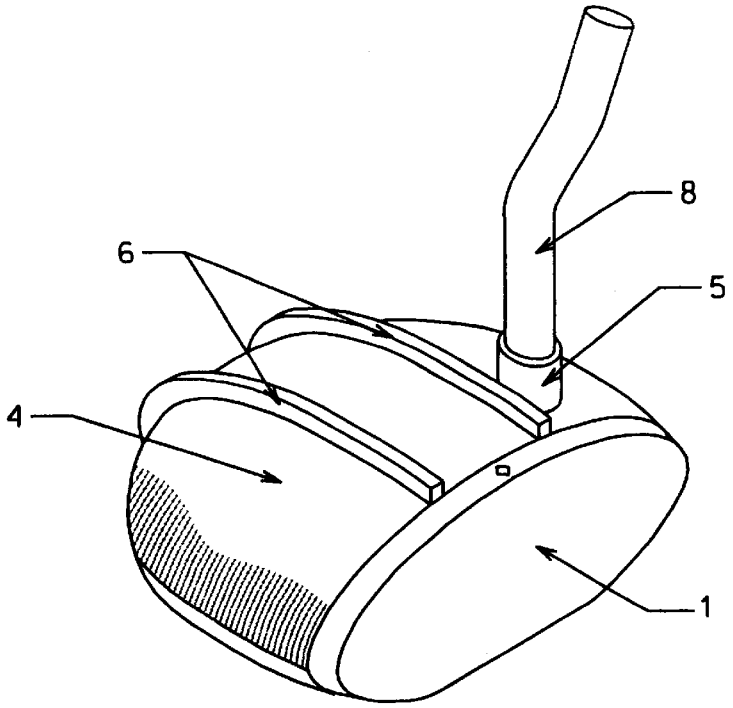
FIG. 3 shows a front perspective of the assembled putter and it's components
Figure 4:
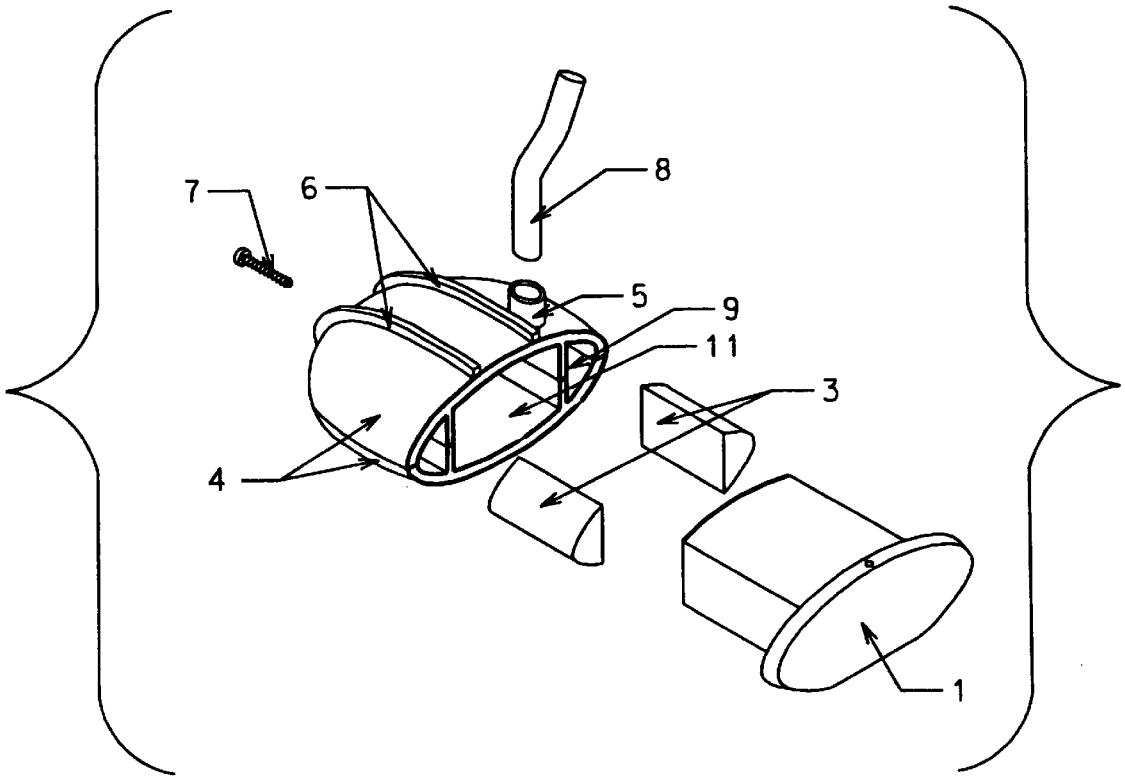
FIG. 4 shows an exploded view of the front perspective and the individual components

1. Face Block Insert
2. Face Block Insert Cavity
3. Weight Inserts
4. Putter Head
5. Raised Hosel or Shaft Mounting Base
6. Sight Rails
7. Face Block Insert Mounting Screw
8. Club Shaft
9. Weight Chamber
11. Face Block Insert Chamber

DETAILED DESIGN SPECIFICATIONS FOR THE MODULAR PUTTER

1) Interchangeable Large Insert One-Piece, Putter Face Blocks

The interchangeable large insert face blocks (1) will be made from different materials such as composites, urethanes, polymers, plastics, brass, aluminum, titanium, berylium, bi-metal alloys, and other materials or alloys. The large insert face blocks will be manufactured in different face loft angles—positive loft (1° to 7° from flat) to flat (90° angle to horizontal) or negative (−1° to −7° from flat). The large insert face blocks will also be available in different groove patterns that can be etched, cast, cut, milled, or molded across the faces. The putter face block faces will be available in different shapes such as concave, convex, and flat. The rear section or back plane of the one piece, face block (2), will be cut out or molded into an elliptical or an elliptical/conical, concave cavity. This cavity design places less face block material behind the sweet spot (geographical center of the putter face) and increases the face block material as you move away from the center point. This design will yield improved consistency with respect to the rebound characteristics, as well as a larger more consistent sweet spot area on the putter face.

Interchangeable putter face blocks (1) will be designed to fit precisely inside the face block insert chamber (11) and will be attached through a rear mounting system consisting of one or more fasteners (7) that attach longitudinally through the back of the putter head (4). The elliptical cavity on the rear of the putter face block (2) will have an internal threaded insert. The putter head (4) will have a longitudinal hole or holes to accommodate the fastener or fasteners.

These face blocks will conform to the US Golf Association's Rules of Golf. It will further be the recommendation of the manufacturer of the modular putter that these faces not be changed during a round of golf because that would violate said Rules of Golf.

The putter faces will be manufactured utilizing any or all of the following processes:

Injection Molding
Investment Casting
Die Casting
Milling
Forging
Extrusion
Stamping
Hand cutting 2) High Center of Gravity Putter Head and Internal Weighting System The putter head (4) will be made from different materials including, but not limited to, composites, polymers, plastics, wood, brass, aluminum, titanium, berylium, bi-metal alloys, and other alloys. The top half of the putter head, as shown in (4) is indicated by the upper portion of the putter head denoted by the equator line drawn around the putter head. It is also shown with partial dark lines filled in on the top half. This upper section of the putter head will be manufactured from a heavier, more dense material than the lower half or will have heavier molded pieces, including the Sight Rails, bonded to the top of the putter heard to raise the putter head's Center of Gravity. This higher center of gravity design will cause the golf ball to leave the putter face on a lower trajectory after initial contact causing the ball to begin rolling more quickly and be less prone to bouncing or hopping.

The putter head (4) will contain two recessed weight chambers (9) on the front side positioned just inboard of the outboard perimeter of the putter head (4). The internal weighting system will consist of two or more longitudinal chambers, slots, or tunnels in the putter head (9) detailed drawing page two. These weight chambers will be of varying depths, diameters, and shapes. The weight chambers can be arranged in symmetrical or asymmetrical arrays. The user/golfer can add or remove weight from the putter head by using internal weight inserts of different weights (3). Removal of the putter face will expose the weight chambers for this purpose. The internal weight inserts will be available in lengths that match the weight chamber depth, as well as shorter segmented lengths for more precise weight adjustment. If segmented weights are used, spacers will be provided to fill the remaining space in the internal weight chambers. The internal weight inserts (3) will be available in various metals and alloys including, but not limited to, lead, tungsten, stainless steel, brass, berylium, iron, bi-metal alloys, and other alloys.

The putter head will have a large cavity in the center of the putter head (4) to accommodate the large insert face block. The putter head will have sight rails built in (6). The putter shaft (8) will be attached through a raised hosel or mounting base (5) in the top of the putter head. The putter heads will be manufactured in right hand or left hand models.

The putter head, weight chambers, internal weight inserts, and weight chamber spacers will be manufactured utilizing any or all of the following processes.

Injection Molding
Investment Casting
Die Casting
Milling
Extrusion
Stamping

3) Sight Rails

The sight rails (6) will be attached or built into the putter head. These rails run longitudinally and parallel to the centerline of the putter head. The sight rails will protrude above the putter head, contribute to the high center of gravity, and serve as an alignment device. The height above the putter head and the thickness of these rails will vary according to the model design and requirements as put forth by the US Golf Association. The sight rails will run from the rear of the putter head to the face. The sight rails will be manufactured utilizing any or all of the following processes:

Injection Molding
Investment Casting
Die Casting
Milling
Forging
Extrusion
Stamping
Hand cutting 4) Elliptical or Effiptical/Conical Concave Cavity on the Rear Section of the Large Insert, One-Piece Face Block, or Rear of the Putter Head The putter will feature an elliptical concave cavity on the rear section, or back side of the large insert face block (2). The cavity will place less face block material behind the center point of the putter's face. The face block material in this cavity increases as you move away from the sweet spot (geographical center point of the putter's face) (2). More material represents more rebound. Less material represents less rebound. This cavity design places less face block material directly behind the sweet spot (geographical center of the putter face) and increases the face block material outward in all directions from the center point. Since the sweet spot, or geographical center of the putter face, traditionally produces more rebound than the area off the center point, it stands to reason that varying the rebound material behind the putter face relative to the center-point can positively affect the rebound characteristics and increase the size of the constant rebound area or sweet spot. This design will yield improved consistency with respect to the rebound characteristics, as well as a larger more consistent sweet spot area on the putter face. The benefit of this elliptical cavity will be improved rebound consistency and putting accuracy even when contacting the golf ball off center from the sweet spot of the putter face.

5) Internal Weight Chambers and Internal Weights

The putter will incorporate an internal weighting system that consists of two or more weight management system adjustments. The weight management system consists of weight chambers (9) located in the putter head situated behind the putter face block, and internal weight insert pieces (3) that fit into the weight chambers. The weight chambers run longitudinally and parallel to the putter head centerline. The first component of the adjustable weighting system is the heel to toe weight bias adjustment. By inserting metallic weight insert pieces (3) of different weights into each side of the putter head weight chambers, the affect will be to vary or adjust the heel to toe weight bias—which in turn will affect the balance of the putter. The second component of the adjustable weighting system is the adjustment of the overall putter head weight. The overall weight can be adjusted by increasing or decreasing the weight of the inserts placed in the heel and toe weight chambers. The heel to toe weight bias can be preserved by maintaining the preferred weight differential between the heel and toe weight inserts regardless of whether the user is increasing or decreasing the overall weight.

The internal weight inserts (3) can either be solid one-piece inserts or segmented weight inserts whose outside diameter and dimensions match and conform to the inside diameter and dimensions of the weight chambers. The one-piece or segmented internal weight inserts (3) will be manufactured from different density metal alloys to provide varying weight possibilities in adjusting the putter's overall weight and/or weight bias.

The internal weighting system provides the user/golfer with the capability of adding or reducing the overall club head weight by removing the face block (1) and inserting, changing, or removing the incremental weighted inserts (3) from the club head. Adding, changing, or removing these weight inserts (3) from the weight chambers (9) on the heel and toe (outer ends of th e face) of the club head will modify balance and to a certain extent, the size of the impact sweet spot on the club face. Weight adjustment in this area will also affect the overall club head weight, as well. Adding, changing, or removing weights (3) from the weight chambers (9) will change the overall club head weight, heel/toe weight bias, and the center of gravity.

With the High CG, Modular Putter the user/golfer can easily remove the putter face (1) and gain access to the internal weight chambers (9). By altering the putter head weight characteristics, the High CG, Modular Putter can be configured more precisely to the user's requirements. This will improve the user's stroke plane, direction, trueness and distance at impact. It will also assist in achieving the correct swing weight for the user, which in combination with the face hardness, will improve ball speed control.

Changing the characteristics of the putter will only be initiated between rounds of golf and not during a round of golf, as that would violate the Rules of Golf as put forth by the United States Golf Association.

What is claimed is:

1. A golf club putter head adapted to be attached to a shaft, said putter head comprising:

a putter head body made of a first material and having a front side, a back side, a top and a sole; said putter head body including an upper section adjacent said top and a bottom half adjacent said sole;

said upper section of the putter head being heavier in weight than the bottom half, whereby the center of gravity of the putter head is raised higher on said head to promote rolling of a struck ball;

said front side including a plurality of openings; said plurality of openings defining at least two recessed weight chambers, with one of said weight chambers positioned adjacent each end of the front side just inboard of the outboard perimeter of the putter head body and extending into the putter head body;

each of said weight chambers further including an internal weight insert selected from a plurality of weight inserts, whereby a golfer may selectively add or remove weight from the putter head by using internal weight inserts of different weights;

said putter head body further including a cavity disposed generally between the weight chambers; said cavity being dimensioned to removably accommodate a face block insert; said face block insert including a striking face defining a face loft angle on one end and a concave generally elliptical cavity located at a rear section of the face block insert at an end opposite to the striking face, whereby the elliptical cavity decreases the material of the face block insert behind the sweet spot of the putter head;

a plurality of sight rails aligned longitudinally and substantially parallel to one another and located above the top of the putter head body; said sight rails extending generally from the rear of the putter head to the front side.

* * * * *